US005294390A

United States Patent [19]

Rosenberg et al.

[11] Patent Number: 5,294,390

[45] Date of Patent: Mar. 15, 1994

[54] METHOD FOR RAPID SPINNING OF A POLYBENZAZOLE FIBER

[75] Inventors: Steven Rosenberg; George J. Quarderer, Jr.; Ashish Sen, all of Midland, Mich.; Masaru Nakagawa, Ohtsu City, Japan; Timothy L. Faley; Myrna Serrano, both of Midland, Mich.; Yoshihiko Teramoto, Ohtsu City, Japan; Chieh-Chun Chau, Midland, Mich.

[73] Assignee: The Dow Chemical Company, Midland, Mich.

[21] Appl. No.: 985,078

[22] Filed: Dec. 3, 1992

[51] Int. Cl.[5] ..... D01D 5/04; D01F 6/26; D02G 3/02

[52] U.S. Cl. ..... 264/103; 264/205; 264/211.16

[58] Field of Search ..... 264/103, 205, 210.8, 264/211.12, 211.14, 211.16, 233

[56] References Cited

U.S. PATENT DOCUMENTS

| | | | |
|---|---|---|---|
| 3,584,104 | 6/1971 | Bohrer et al. | 264/205 |
| 4,702,876 | 10/1987 | Ebregt et al. | 264/184 |
| 4,945,156 | 7/1990 | Jenekhe et al. | 264/211.16 X |
| 5,174,940 | 12/1992 | Kumar et al. | 264/184 |

OTHER PUBLICATIONS

U.S. patent application Ser. No. 07/985,067, Filed Dec. 3, 1992.

U.S. patent application Ser. No. 07/985,068, Filed Dec. 3, 1992.

U.S. patent application Ser. No. 07/985,079, Filed Dec. 3, 1992.

U.S. patent application Ser. No. 07/985,080, filed Dec. 3, 1992.

Abstract of Japan 2-84,509, Published Mar. 26, 1990.

Abstract of Japan 2-84,510, Published Mar. 26, 1990.

Abstract of Japan 2-84,511, Published Mar. 26, 1990.

Abstract of Japan 3-104,920, Published May 1, 1991.

Abstract of Japan 3-104,921, Published May 1, 1991.

Abstract of Japan 4-194,022, Published Jul. 14, 1992.

U.S. patent application Ser. No. 07/984,828, Filed Dec. 3, 1992.

U.S. patent application Ser. No. 07/985,060, Filed Dec. 3, 1992.

MRS, vol. 134, The Materials Science and Engineering of Rigid-Rod Polymers, "*An Integrated Laboratory Process For Preparing Rigid Rod Fibers From The Monomers*" Harvey D. Ledbetter et al. pp. 253-264.

Encyclopedia of Polymer Science and Engineering, Second Edition, vol. 11, "*Polybenzothiazoles and Polybenzoxazoles*", *by James F. Wolfe, PP. 601-635 (undated).*

MRS Bulletin, Nov. 16/Dec. 31, 1987 "*High Performance Polymer Fibers*" *W. Adams et al. pp. 22-26.*

Macromolecules, 1981, vol. 14, "*Synthesis, Spinning & Fiber Mechanical Properties of Poly (p-phenylenebenzobisoxazole)*" by E. Won Choe and Sang Nim Kim: pp. 920-924.

*Primary Examiner*—Leo B. Tentoni

*Attorney, Agent, or Firm*—Margaret Brumm

[57] ABSTRACT

Polybenzazole polymer dopes are spun through a spinneret having more than 2 per $cm^2$, of orifices in relatively close proximity. The dope filaments formed, then pass through an air gap which has a temperature of 50° to 100° C. and a gas flow sufficient to uniformly reduce the temperature of the dope filaments. The filaments cool in the air gap and are then coagulated.

4 Claims, No Drawings

METHOD FOR RAPID SPINNING OF A POLYBENZAZOLE FIBER

BACKGROUND OF THE INVENTION

The present invention relates to improved processes for spinning fibers that contain polybenzoxazole ("PBO") or polybenzothiazole ("PBT") polymer.

Lyotropic liquid crystalline polybenzoxazole and polybenzothiazole are not thermoplastic. They are typically made into fibers by dry-jet, wet-spinning techniques, in which a dope that contains the polybenzazole polymer and an acid solvent is spun through a spinneret, drawn across an air gap, and coagulated by contact with a fluid that dilutes the solvent and is a non-solvent for the polymer. The individual filaments formed by this process can be combined to form one or more fibers of varying diameter.

It is desirable to spin a large number of filaments in a short time and at a high rate of speed. It is also desirable to minimize the cross-sectional area of the individual filaments within a fiber, producing a continuous fiber with many low denier filaments rather than a few high denier filaments. However, thinner filaments have a greater tendency to break during spinning, especially at high speed and when the spinneret contains orifices for a large number of filaments. It is desirable to minimize the number of filament breaks.

SUMMARY OF THE INVENTION

The present invention is a process to spin a fiber made up of more than one filament from a liquid-crystalline dope that contains a solvent and a polybenzazole polymer which is polybenzoxazole, polybenzothiazole or a copolymer thereof, said process comprising the steps of:

(A) spinning the dope at a temperature greater than 100° C. through a spinneret that contains a plurality of orifices, wherein the density of orifices in the spinneret is at least 2.0 per $cm^2$, whereby a plurality of dope filaments is formed;

(B) drawing the dope filaments across an air gap that contains a gas at a temperature of 50° C. to 100° C., wherein the gas flows through the air gap at a rate sufficient to uniformly reduce the temperature of the dope filaments; and (C) contacting the drawn dope filaments with a washing fluid such that the solvent is removed from the filaments.

A second aspect of this invention is a polybenzazole fiber with an average fiber diameter of no more than about 18 μm obtained through the process described above.

It is theorized that when a large number of polybenzazole filaments are spun close together at a high temperature, the outer filaments cool faster than the inner filaments. The different filament temperatures mean that spinning conditions that are optimal for the outer filaments are not best for the inner filaments, and vice-versa. The gas flow in the air gap ensures that all of the filaments experience a similar surrounding temperature. A controlled surrounding temperature acts to minimize filament breaks. It provides the additional advantages of making the filaments more uniform.

DETAILED DESCRIPTION OF THE INVENTION

The present invention uses dopes that contain a polybenzazole polymer, which is polybenzoxazole, polybenzothiazole or a copolymer of those polymers. PBO, PBT and random, sequential and block copolymers of PBO and PBT are described in references such as Wolfe et al., *Liquid Crystalline Polymer Compositions, Process and Products*, U.S. Pat. No. 4,703,103 (Oct. 27, 1987); Wolfe et al., *Liquid Crystalline Polymer Compositions, Process and Products*, U.S. Pat. No. 4,533,692 (Aug. 6, 1985); Wolfe et al., *Liquid Crystalline Poly(2,6-Benzothiazole) Compositions, Process and Products*, U.S. Pat. No. 4,533,724 (Aug. 6, 1985); Wolfe, *Liquid Crystalline Polymer Compositions, Process and Products*, U.S. Pat. No. 4,533,693 (Aug. 6, 1985); Evers, *Thermoxadalively Stable Articulated p-Benzobisoxazole and p-Benzobisthiazole Polymers*, U.S. Pat. No. 4,359,567 (Nov. 16, 1982); Tsai et al., *Method for Making Heterocyclic Block Copolymer*, U.S. Pat. No. 4,578,432 (Mar. 25, 1986); 11 Ency. Poly. Sci. & Eng., *Polybenzothiazoles and Polybenzoxazoles*, 601 (J. Wiley & Sons 1988) and W. W. Adams et al., *The Materials Science and Engineering of Rigid-Rod Polymers* (Materials Research Society 1989).

The polymer may contain AB-mer units, as represented in Formula 1(a), and/or AA/BB-mer units, as represented in Formula 1(b)

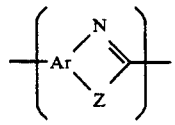

1(a) AB

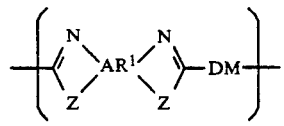

1(b) AA/BB wherein:

Each Ar represents an aromatic group selected such that the polybenzazole polymer is a lyotropic liquid-crystalline polymer (i.e. it forms liquid crystalline domains when its concentration in solution exceeds a "critical concentration point"). The aromatic group may be heterocyclic, such as a pyridinylene group, but it is preferably carbocyclic. The aromatic group may be a fused or unfused polycyclic system, but is preferably a single six-membered ring. Size is not critical, but the aromatic group preferably contains no more than about 18 carbon atoms, more preferably no more than about 12 carbon atoms and most preferably no more than about 6 carbon atoms. $Ar^1$ in AA/BB-mer units is preferably a 1,2,4,5-phenylene moiety or an analog thereof. Ar in AB-mer units is preferably a 1,3,4-phenylene moiety or an analog thereof.

Each Z is independently an oxygen or a sulfur atom.

Each DM is independently a bond or a divalent organic moiety selected such that the polybenzazole polymer is a lyotropic liquid crystalline polymer. The divalent organic moiety is preferably an aromatic group (Ar) as previously described. It is most preferably a 1,4-phenylene moiety or an analog thereof.

The nitrogen atom and the Z moiety in each azole ring are bonded to adjacent carbon atoms in the aromatic group, such that a five-membered azole ring fused with the aromatic group is formed.

The azole rings in AA/BB-mer units may be in cis- or transposition with respect to each other, as illustrated in 11 Ency. Poly. Sci. & Eng., supra, at 602, which is incorporated herein by reference.

The polymer preferably consists essentially of either AB-PBZ mer units or AA/BB-PBZ mer units, and more preferably consists essentially of AA/BB-PBZ mer units. Azole rings within the polymer are preferably oxazole rings (Z=0).

Preferred mer units are illustrated in Formulae (a)–(h). The polymer more preferably consists essentially of mer units selected from those illustrated in 2(a)–(h), and most preferably consists essentially of a number of identical units selected from those illustrated in 2(a)–(d).

(a)

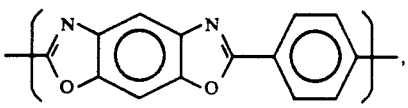

(b)

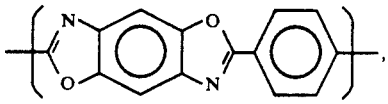

(c)

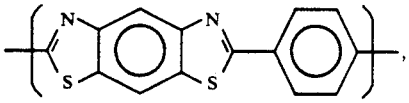

(d)

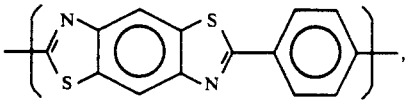

(e)

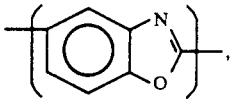

(f)

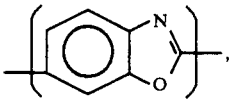

(g)

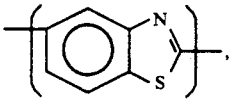

and (h)

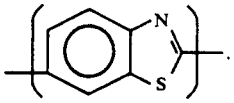

Each polymer preferably contains on average at least about 25 repeating units, more preferably at least about 50 repeating units and most preferably at least about 100 repeating units. The intrinsic viscosity of rigid AA/BB-PBZ polymers in methanesulfonic acid at 25° C. is preferably at least about 10 dL/g, more preferably at least about 15 dL/g and most preferably at least about 20 dL/g. For some purposes, an intrinsic viscosity of higher than 25 dL/g or 30 dL/g may be best. Intrinsic viscosities of 60 dL/g are possible. The intrinsic viscosity of semi-rigid AB-PBZ polymers is preferably at least about 5 dL/g, more preferably at least about 10 dL/g and most preferably at least about 15 dL/g.

The polymer or copolymer is dissolved in a solvent to form a solution or dope. Some polybenzoxazole and polybenzothiazole polymers are soluble in cresol, but the solvent is preferably an acid capable of dissolving the polymer. The acid is preferably non-oxidizing. Examples of suitable acids include polylphosphoric acid, methanesulfonic acid and sulfuric acid and mixtures of those acids. The acid is preferably polyphosphoric acid and/or methanesulfonic acid, and is more preferably polyphosphoric acid.

The dope should contain a high enough concentration of polymer for the dope to contain liquid-crystalline domains. The concentration of the polymer is preferably at least about 7 weight percent, more preferably at least about 10 weight percent and most preferably at least about 14 weight percent. The maximum concentration is limited primarily by practical factors, such as polymer solubility and dope viscosity. The concentration of polymer is seldom more than 30 weight percent, and usually no more than about 20 weight percent.

Suitable polymers or copolymers and dopes can be synthesized by known procedures, such as those described in Wolfe et al., U.S. Pat. No. 4,533,693 (Aug. 6, 1985); Sybert et al., U.S. Pat. No. 4,772,678 (Sep. 20, 1988); Harris, U.S. Pat. No. 4,847,350 (Jul. 11, 1989); Gregory, U.S. Pat. No. 5,089,591 (Feb. 18, 1992); and Ledbetter et al., "An Integrated Laboratory Process for Preparing Rigid Rod Fibers from the Monomers," *The Materials Science and Engineering of Rigid-Rod Polymers* at 253–64 (Materials Res. Soc. 1989). In summary, suitable monomers (AA-monomers and BB-monomers or AB--monomers) are reacted in a solution of nonoxidizing and dehydrating acid under nonoxidizing atmosphere with vigorous mixing and high shear at a temperature that is increased in step-wise or ramped fashion from no more than about 120° C. to at least about 190° C. Examples of suitable AA-monomers include terephthalic acid and analogs thereof. Examples of suitable BB-monomers include 4,6-diaminoresorcinol, 2,5-diaminohydroquinone, 2,5-diamino-1,4-dithiobenzene and analogs thereof, typically stored as acid salts. Examples of suitable AB-monomers include 3-amino-4-hydroxybenzoic acid, 3-hydroxy-4-aminobenzoic acid, 3-amino-4-thiobenzoic acid, 3-thio-4-aminobenzoic acid and analogs thereof, typically stored as acid salts.

In order for the most efficient spinning, the dope should preferably be very homogeneous and free of gas bubbles and solid particulates. This can be accomplished, but by no means is limited to, by implementation of shear-filtration media (extensive known shear-filtration media includes the use of silica sand, metal filings and particulates, glass beads, sintered ceramics, sintered porous metal plates and shaped structures and metal screens). Additional known homogenizing equipments includes single- and multiple-screw extruders, static mixers and other mixing devices.

The dope is spun from a spinneret that contains a plurality of orifices. The density of orifices in the spinneret should be at least about 1.0 per $cm^2$ preferably at least about 2.0 per $cm^2$, and more preferably at least about 3.0 per $cm^2$. Each orifice may be of any size desired, but the average diameter at the point where the dope leaves the spinneret is preferably no more than about 0.5 mm, more preferably no more than about 0.4 mm, and most preferably no more than about 0.35 mm. The orifices may be in any desired arrangement, but it is convenient to use a circular or lattice shaped arrangement.

The dope is spun through the spinneret at a temperature greater than 100° C. The temperature is preferably at least about 120° C. and more preferably at least about 140° C. The maximum temperature is limited by the stability of the dope. It is preferably no more than about 220° C. and more preferably no more than about 200° C. The optimum rate at which dope passes through the spinneret varies depending upon the spinneret, the dope and the conditions in which they are used.

Dope filaments exiting the spinneret enter a gap between the spinneret and the coagulation zone where the dope can be drawn. The gap is typically called an "air gap" although it need not contain air. The gap may contain any gas that does not induce coagulation or react adversely with the dope, such as air, nitrogen, argon, helium or carbon dioxide. The spin draw ratio is the ratio of the take-up velocity of the fiber divided by the extrusion velocity of the dope. In the air gap, the dope filaments are drawn to a spin-draw ratio that is at least about 10, preferably at least about 20, highly preferably at least about 40, more highly preferably at least about 50 and most highly preferably at least about 63. The length of the air gap is usually at least about 5 em and at most about 100 cm, although longer and shorter air gaps may be used.

The gas in the air gap is at a temperature of at least about 50° C. and at most about 100° C. The temperature is more preferably between about 60° C. and about 90° C. The gas serves to cool the filaments before they are contacted with a washing fluid. If the temperature is less than 50° C., the filaments cool too fast. When the filaments cool too fast it has been observed that the spinning stress increases rapidly and spinning becomes unstable. This is believed to be the result of the high activation energy of extensional (elongational) flow. If the temperature is more than 100° C., resonance-like spinning instability is believed to occur.

The cooling gas in the air gap flows at a rate sufficient to uniformly reduce the temperature of the dope filaments, so that the filaments all experience about the same cooling profile. The rate of gas flow is between about 0.02 m/sec. and 0.1 m/sec., more preferably between 0.05 m/sec and 0.08 m/sec. and most preferably between 0.075 m/sec. and 0.08 m/see. The gas flow is preferably perpendicular to the direction in which the filaments move through the air gap.

After the dope filament has been drawn, it is contacted with a fluid that dilutes the solvent and is a non-solvent for the polybenzazole polymer. The process of separating the solvent from the polymer is usually referred to as coagulation in the beginning and later, as most of the solvent is removed, as washing. The fluid may be a gas, such as steam, but it is preferably a liquid and more preferably an aqueous liquid. The fiber may be contacted with fluid in a bath or spray form. The bath may be in many different forms, such as the baths described in Japan Open Laid Patent NO. 63-12710; Japan Open Laid Patent NO. 51-35716; or Japan Published Patent NO. 44-22204, which are incorporated herein by reference. The fiber is preferably washed until the residual solvent is reduced to less than about 2.0 percent, more preferably less than 0.5 percent and most preferably less than about 0.1 percent.

The filaments produced by this process are typically combined into one or more fibers of varying thickness. This combination step usually takes place during the process of making the filament at the stage before, during or after the coagulation/washing of the filament. Fibers made-up of one filament are referred to as monofilament fibers and fibers made up of more than one filament are referred to as multi-filament fibers. A fiber tow is "a large strand of continuous manufactured fiber filaments without definite twist, collected in loose, rope-like form, usually held together by crimp." (*Dictionary of Fiber & Textile Technology*, copyright 1990 by Hoechst Celanese.)

The coagulated and washed fiber may be collected and dried by known methods. It may be heat-treated to increase tensile modulus if desired. A finish may also be applied if desired.

Fibers may be produced by the process at high speed. The speed (measured after the coagulation/washing step) at which fiber is produced is preferably at least about 75 re/min., more preferably at least about 100 re/min., and most preferably at least about 200 re/min. Line speeds of 400 re/min., 600 re/min. or more are possible under optimal conditions.

The resulting fiber preferably has an average diameter of no more than about 21 μm(0.83 mils), more preferably no more than about 19 μm(0.75 mils) and most preferably no more than about 15 μm(0.59 mils). Its denier ("denier" is the weight in grams of 9000 meters of any fiber) is preferably no more than about 5 dpf ("denier-per-filament") and more preferably no more than about 4 dpf. The minimum filament diameter and denier are limited by practical considerations. Each individual filament usually has an average diameter of about 8μm (0.32 mils) and an average denier of at least about 0.70 dpf. The average tensile strength of the fiber is preferably at least about 200 ksi (1.38 GPa), more preferably at least about 400 ksi (2.76 GPa), more highly preferably at least about 600 ksi (4.14 GPa), and most preferably at least about 800 ksi (5.48 GPa). The tensile modulus of the heat-treated fiber is preferably at least 35 msi (241 GPa) and more preferably at least 42 msi (290 GPa). The tensile modulus of non-heat-treated fiber is usually less than (about half of) the tensile modulus of heat-treated fiber.

The present invention improves the stability in the simultaneously spinning of a large number of closely spaced filaments. It makes it possible to effectively spin while minimizing line breaks. It has the additional benefits of reducing denier variation between different filaments.

EXAMPLES

The following examples are for illustrative purposes only. They should not be taken as limiting the scope of either the specification or the claims. Unless stated otherwise, all parts and percentages are by weight.

EXAMPLE 1

Spinning of PBO dope

A polymer solution which consists of 14 wt% of cis-polybenzoxazole (30 I.V.) and polyphosphoric acid is extruded from the spinneret at 160° C. under the conditions shown in Table 1. The extruded filaments are coagulated in deionized water at about room temperature. The resulting fiber is washed as it travels around five rollers. The surface water is removed using an air knife, and the fiber passes over a series of heated roller pairs at sequentially increasing temperatures to dry. Table 1 describes the observations of spinning and the physical properties for each fiber. The Table shows that filament breaks occur more frequently when spinning at high speeds outside of the claimed conditions. Table 1 refers to tenacity (tensile strength) in terms of grams/-denier. For polybenzoxazole, one gram/denier is approximately equivalent to 20 ksi (the direct equivalency is ksi=12.83 gram/denier times density of fiber which for PBO yields an equivalency of 20.481 ksi).

TABLE 1

| Experimental # SPINNING SPECIFICATIONS/PROPERTIES | unit | A example | B reference | C reference | D reference | E reference | F reference |
|---|---|---|---|---|---|---|---|
| Through-put per spinneret | g/min | 79.9 | 79.9 | 79.9 | 47.9 | 79.9 | 79.9 |
| No. of orifices | | 334 | 334 | 334 | 334 | 334 | 334 |
| Diameter of orifice | mm | 0.22 | 0.22 | 0.22 | 0.17 | 0.22 | 0.22 |
| Through-put per orifice | ml/ml nute | 0.12 | 0.12 | 0.12 | 0.07 | 0.12 | 0.12 |
| Shear rate | /sec | 1946 | 1946 | 1946 | 2529 | 1946 | 1946 |
| Orifice density | /cm2 | 5.00 | 5.00 | 5.57 | 5.00 | 5.00 | 5.00 |
| Surface area of Spinneret | cm2 | 66.8 | 66.8 | 60 | 66.8 | 66.8 | 66.8 |
| Distance between Spinneret and quench chamber | cm | 2 | — | — | — | 2 | 2 |
| Length of Quench Chamber | cm | 20 | — | — | — | 20 | 20 |
| Quench air velocity | m/sec | 0.2 | — | — | — | 0.2 | 0.2 |
| Quench air temperature | °C. | 70 | — | — | — | 110 | 40 |
| Distance between spinneret and coagulation bath | cm | 35 | 35 | 35 | 35 | 35 | 35 |
| Spinning speed | m/min | 200 | 200 | 200 | 120 | 200 | 200 |
| Spin Draw Ratio | | 63 | 63 | 63 | 37 | 63 | 63 |
| Spinnability | | Excellent | Impossible | Poor | Good | Impossible | Impossible |
| Fiber breaks | T/hrs | 0.02 | >20 | 2.8 | 1.3 | >20 | >20 |
| Washing/Drying | | IN-LINE | | | IN-LINE | | |
| Dry fiber properties | | | | | | | |
| Denier | | 501 | | | 499 | | |
| Filament Denier | dpf | 1.5 | | | 1.5 | | |
| Tenacity | g/d | 40 | | | 38 | | |
| Elongation at break | % | 3.9 | | | 3.8 | | |
| Tensile Modulus | g/d | 1119 | | | 1056 | | |
| Weathering test | % | 89 | | | 88 | | |
| Moisture Content | % | 0.7 | | | 0.8 | | |
| Void Generation | | None | | | None | | |
| Kink Bond | | None | | | None | | |
| Heat Treatment | | OFF LINE | | | OFF LINE | | |
| Temperature of Heat Treatment | °C. | 550 | | | 550 | | |
| Residence time | sec | 10 | | | 10 | | |
| Stress of heat treatment | g/d | 4.5 | | | 4.5 | | |
| Heat treated fiber properties | | | | | | | |
| Tenacity | g/d | 34 | | | 35 | | |
| Elongation at break | % | 2.0 | | | 2.0 | | |
| Tensile Modulus | g/d | 2230 | | | 2201 | | |
| Weathering test | % | 90 | | | 89 | | |
| Void Generation | | None | | | None | | |
| Kink Bond | | Few | | | Few | | |

| Experimental # SPINNING SPECIFICATIONS/PROPERTIES | unit | G example | H reference | I example | J example | K reference |
|---|---|---|---|---|---|---|
| Through-put per spinneret | g/min | 79.9 | 79.9 | 40 | 152 | 151 |
| No. of orifices | | 334 | 334 | 167 | 167 | 100 |
| Diameter of orifice | mm | 0.22 | 0.22 | 0.25 | 0.32 | 0.4 |
| Through-put per orifice | ml/ml nute | 0.12 | 0.12 | 0.12 | 0.46 | 0.77 |
| Shear rate | /sec | 1946 | 1946 | 1328 | 2407 | 2045 |
| Orifice density | /cm2 | 5.00 | 5.00 | 4.00 | 4.00 | 2.39 |
| Surface area of Spinneret | cm2 | 66.8 | 66.8 | 41.8 | 41.8 | 41.8 |
| Distance between Spinneret and quench chamber | cm | 2 | 2 | 2 | 3 | 3 |
| Length of Quench Chamber | cm | 20 | 20 | 35 | 50 | — |
| Quench air velocity | m/sec | 0.6 | 0.01 | 0.2 | 0.2 | — |
| Quench air temperature | °C. | 70 | 22 | 60 | 60 | — |
| Distance between spinneret and coagulation bath | cm | 35 | 35 | 35 | 50 | 50 |
| Spinning speed | m/min | 200 | 200 | 200 | 380 | 380 |
| Spin Draw Ratio | | 63 | 63 | 80 | 64 | 62 |
| Spinnability | | Poor | Impossible | Excellent | Good | Good |
| Fiber breaks | T/hrs | 3.3 | >20 | 0.015 | 0.5 | 0.62 |
| Washing/Drying | | IN-LINE | | IN-LINE | OFF-LINE | OFF-LINE |
| Dry fiber properties | | | | | | |
| Denier | | 503 | | 250 | 501 | 499 |
| Filament Denier | dpf | 1.5 | | 1.5 | 3 | 5 |
| Tenacity | g/d | 39 | | 40 | 39 | 41 |
| Elongation at break | % | 3.8 | | 3.8 | 8.7 | 3.9 |
| Tensile Modulus | g/d | 1187 | | 1211 | 1128 | 998 |
| Weathering test | % | 86 | | 89 | 82 | 78 |
| Moisture Content | % | 0.7 | | 0.7 | 0.8 | 0.8 |
| Void Generation | | None | | None | None | None |
| Kink Bond | | None | | None | Some | Some |
| Heat Treatment | | OFF LINE | | OFF LINE | OFF LINE | OFF LINE |

TABLE 1-continued

| | | | | | |
|---|---|---|---|---|---|
| Temperature of Heat Treatment | °C. | 550 | 550 | 550 | 550 |
| Residence time | sec | 10 | 10 | 10 | 10 |
| Stress of heat treatment | g/d | 4.5 | 4.5 | 4.5 | 4.5 |
| Heat treated fiber properties | | | | | |
| Tenacity | g/d | 35 | 39 | 38 | 38 |
| Elongation at break | % | 2.0 | 2.1 | 2.0 | 2.1 |
| Tensile Modulus | g/d | 2175 | 2231 | 2047 | 1984 |
| Weathering test | % | 91 | 90 | 88 | 85 |
| Void Generation | | None | None | None | None |
| Kink Bond | | Few | Few | Some | Some |

What is claimed is:

1. A process for making a fiber made up of more than one filament from a liquid-crystalline dope that contains a solvent and a polybenzazole polymer which is polybenzoxazole, polybenzothiazole or a copolymer thereof, said process comprising the steps of:

(1) spinning the dope at a temperature greater than 100° C. through a spinneret that contains a plurality of orifices, wherein the density of orifices in the spinneret is at least 2.0 per $cm^2$, whereby a plurality of dope filaments is formed;

(2) drawing the dope filaments across an air gap that contains a gas at a temperature of 50° C. to 100° C., wherein the gas flows through the air gap at a rate sufficient to uniformly reduce the temperature of the dope filaments;

(3) contacting the drawn dope filaments with a fluid such that the solvent is removed from the filaments, and;

(4) conducting the process such that the filaments are combined into one or more fibers before, during or after the time said filaments are contacted with said fluid.

2. The process of claim 1 in which the flow rate of the gas in the air gap is at least 0.02 meters/second.

3. The process of claim 1 in which the flow rate of the gas in the air gap is at least 0.05 meters/second.

4. The process of claim 1 in which the flow rate of the gas in the air gap is at least 0.1 meters/second.

* * * * *